United States Patent [19]

Masin

[11] 4,032,918

[45] June 28, 1977

[54] DUAL CHANNEL RADIO FREQUENCY FUZING SYSTEM

[75] Inventor: George F. Masin, Anaheim, Calif.

[73] Assignee: The United States of America as represented by the Secretary of the Navy, Washington, D.C.

[22] Filed: Apr. 30, 1964

[21] Appl. No.: 364,893

[52] U.S. Cl. ..... 343/7 PF

[51] Int. Cl.[2] ..... F42C 13/04

[58] Field of Search ..... 343/7 ED, 7 PF; 102/70.2 P; 307/320; 331/177 R, 177 V; 325/160, 172

[56] References Cited

UNITED STATES PATENTS

| | | | |
|---|---|---|---|
| 3,562,752 | 2/1971 | Roeschke | 343/7 PF X |
| 3,833,905 | 9/1974 | Apstein | 343/7 PF |
| 3,877,377 | 4/1975 | Rabinow | 343/7 PF X |
| 3,945,008 | 3/1976 | Schmucker | 343/7 PF |

*Primary Examiner*—T.H. Tubbesing
*Attorney, Agent, or Firm*—Richard S. Sciascia; Joseph M. St.Amand; T. M. Phillips

EXEMPLARY CLAIM

1. In a dual-channel radio frequency fuzing system the combination comprising:
   a. an oscillator circuit including a loop antenna tank circuit adapted to operate at a first predetermined frequency in response to a first modulating signal having a first repetition rate,
   b. circuit means coupled to the tank circuit of said oscillator for causing said oscillator to operate at a second predetermined frequency in response to a modulating signal derived from said first modulating signal and having a repetition rate different than said first repetition rate.

5 Claims, 1 Drawing Figure

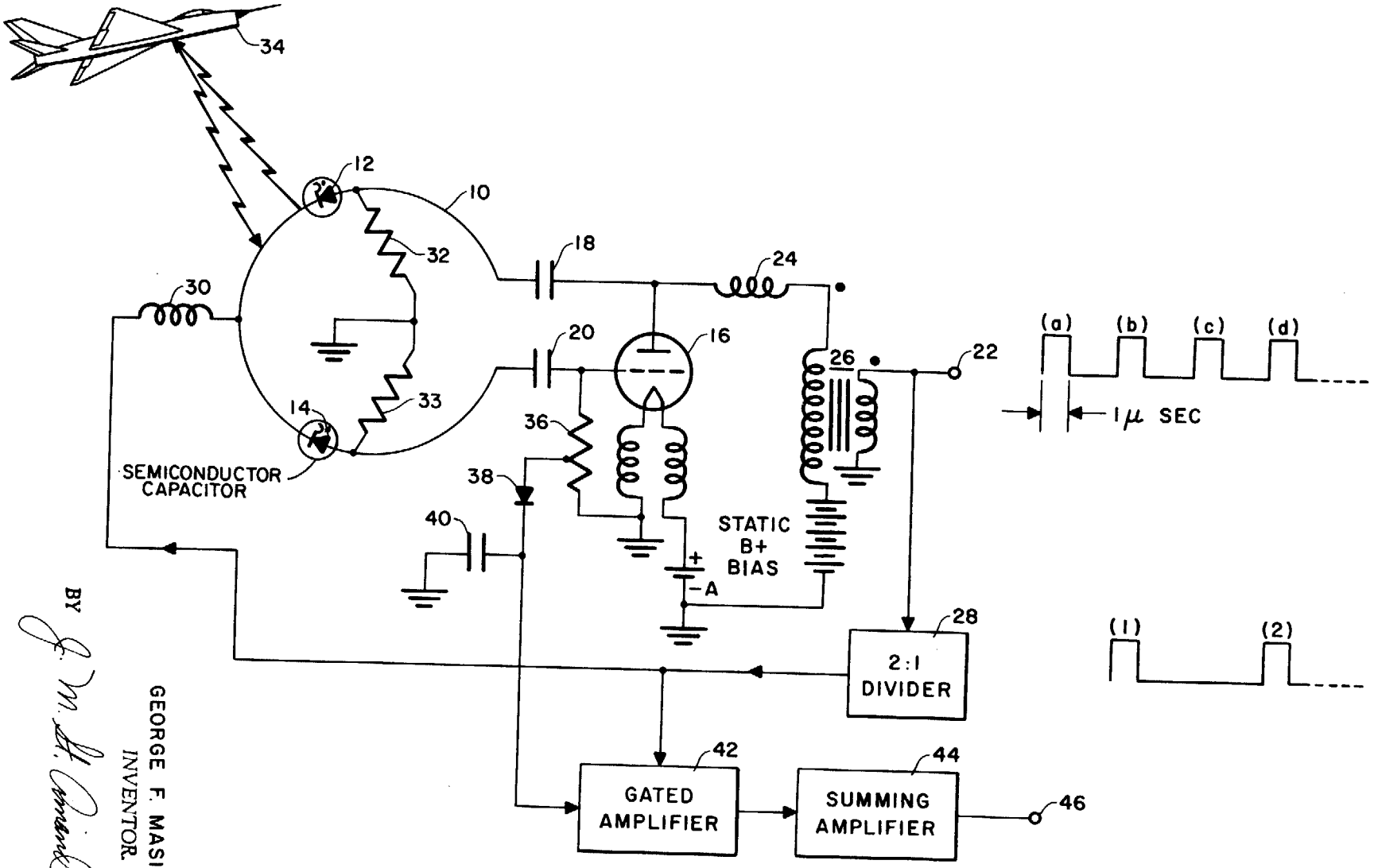
GEORGE F. MASIN
INVENTOR.
BY J. M. St. Amand
ATTORNEY

DUAL CHANNEL RADIO FREQUENCY FUZING SYSTEM

The invention herein described may be manufactured and used by or for the Government of the United States of America for governmental purposes without the payment of any royalties thereon or therefor.

The present invention relates to dual channel (dual frequency) radio frequency fuzing systems and more particularly to dual channel radio frequency fuzing systems employing a single antenna-oscillator and gated receiver amplifier.

There are no known fuze systems which can effectly nullify countermeasures equipment especially against sweep or spot frequency jammers. The present invention provides a dual-channel fuzing system which is immune to countermeasures signals that occupy the same frequency spectrum as a single fuze channel. It obtains the effect of a two channel fuzing system by switching from one channel to the other and requires that the received signals be correlated with the like transmitted signals and that these be present in both channels before the fuze will fire.

Accordingly, an object of the invention is the provision of a dual-channel radio frequency fuzing system that is not susceptible to sweep or spot frequency countermeasures jamming.

Another object of the invention is to provide a dual-channel radio frequency firing system that is not susceptible to countermeasures jamming wherein cross-talk and mutual interference between the two channels is eliminated; less space is required for the components and power requirements are reduced.

Other objects and many of the attendant advantages of this invention will become readily appreciated as the same becomes better understood by reference to the following detailed description when considered in connection with the accompanying drawing wherein:

The single FIGURE of drawing is a schematic diagram of a preferred embodiment utilizing a loop antenna tank circuit.

Loop antenna 10 which includes semiconductor capacitors 12 and 14 and oscillator tube 16 comprise a radio frequency oscillator-detector utilizing reaction grid detector principal used in many types of proximity fuze systems. Antenna 10 is coupled to tube 16 through isolating capacitors 18 and 20. Oscillator tube 16 is coupled to a source of modulation excitation pulses supplied at terminal 22 through isolating choke 24 and modulation transformer 26. The excitation pulses applied to terminal 22 are also fed to a pulse count divider 28 which may be of any well known type and would provide a 2:1 divider with the waveforms as shown in the figure. The output from divider 28 is coupled through isolation choke 30 to loop antenna 10 and semiconductor capacitors 12 and 14. Balanced load resistors 32 and 33 are connected from loop antenna 10 to ground and provide balanced loads for semiconductor capacitors 12 and 14.

Energy radiated at two frequencies, alternately, from oscillator antenna 10 is reflected from a target 34 and is received by antenna 10. The energy received is detected in oscillator-detector tube 16 and provides an output signal across grid resistor 36. Diode 38 and capacitor 40 act as a peak detector to eliminate pulse repetition frequency from the detected signal. The detected signal is coupled to a gated amplifier 42 which correlates the received intelligence so that it corresponds to the oscillator modes of operation determined by the modulation pulse.

A gated amplifier which will correlate the received intelligence so that it corresponds to the oscillator modes of operation may be of the type shown and described on page 109, FIG. 6 of *Static Relays for Electronic Circuits*, Engineering Publishers, Elizabeth, N.J. 1961. The outputs from gating amplifier 42 is coupled to summing amplifier 44 which will generate an output firing signal only when a signal appears in each of the outputs from gated amplifier 42. A summing circuit which will generate an output firing signal only when a signal appears from each channel of gated amplifier 42 may be a step counting circuit with an RC time constant such that in the absence of two successive pulses at the input, the capacitor will have discharged. The step counter could be of the type shown in FIG. 255, page 233 of Radar Electronic Fundamentals, NAVSHIPS 900,016, Superintendent of Documents, U.S. Government Printing Office, 1944.

The operation of the system is as follows: when the first pulse is received at terminal 22, a radio frequency signal will be radiated from antenna 10 having a frequency determined principally by the inductance of loop antenna 10 and the capacitance of tube 16. When two pulses have been received at terminal 22 and divider 28, a pulse will also be fed to and change the capacitance of semiconductor capacitors 12 and 14. The radio frequency now radiated is determined by the inductance of loop antenna 10, the capacitance of tube 16 and the capacitance of semiconductor capacitors 12 and 14.

Reflected signals from target 34 are received at antenna 10 and detected in the oscillator detector circuit and fed as a firing signal to output terminal 46 only when signals received correspond to the modes of operation established by the input modulation pulses.

Obviously many modifications and variations of the present invention are possible in the light of the above teachings. It is therefore to be understood that within the scope of the appended claims the invention may be practiced otherwise than as specifically described.

What is claimed is:

1. In a dual-channel radio frequency fuzing system the combination comprising:

a. an oscillator circuit including a loop antenna tank circuit adapted to operate at a first predetermined frequency in response to a first modulating signal having a first repetition rate, b. circuit means coupled to the tank circuit of said oscillator for causing said oscillator to operate at a second predetermined frequency in response to a modulating signal derived from said first modulating signal and having a repetition rate different than said first repetition rate.

2. In a dual-channel radio frequency fuzing system the combination comprising:

a. an oscillator circuit including a radiating and receiving loop antenna adapted to operate at a first predetermined frequency in response to a first modulating signal having a first repetition rate, b. circuit means coupled to said loop antenna for causing said oscillator to operate at a second frequency in response to a second modulating signal derived from said first modulating signal and having a repetition rate different than said first repetition rate.

3. In a dual-channel, dual frequency radio fuzing system comprising:

a. an oscillator circuit including a radiating and receiving loop antenna adapted to operate at a first predetermined frequency in response to a first modulating signal having a first repetition rate, b. said loop antenna including voltage responsive variable capacitor means, c. circuit means coupled to said variable capacitor means for causing the reactance of said loop antenna to change the operating frequency of said oscillator to a second frequency in response to a second modulating signal derived from said first modulating signal and having a repetition rate different than said first repetition rate.

4. In a dual-channel, dual frequency fuzing system the combination comprising:

a. an oscillator comprising an oscillator tube and a loop antenna tank circuit, b. an input terminal coupled to said oscillator tube and adapted to have a first modulating voltage of a predetermined repetition rate of pulses for exciting said oscillator into oscillation at a first frequency, c. circuit means coupled to said input terminal and to said loop antenna tank circuit for applying a second modulating voltage derived from said first modulating voltage and being of a predetermined repetition rate of pulses different than said first predetermined repetition rate for changing the reactance of said loop antenna and the operating frequency of said oscillator.

5. The fuzing system of claim 4 wherein said loop antenna tank circuit includes voltage responsive variable capacitor means.

* * * * *